United States Patent [19]

Roeder

[11] Patent Number: 4,768,589

[45] Date of Patent: Sep. 6, 1988

[54] DOWNHOLE HYDRAULIC ACTUATED PUMP

[76] Inventor: George K. Roeder, P.O. Box 4335, Odessa, Tex. 79760

[21] Appl. No.: 9,684

[22] Filed: Feb. 2, 1987

Related U.S. Application Data

[63] Continuation-in-part of Ser. No. 712,888, Mar. 18, 1985, Pat. No. 4,664,186.

[51] Int. Cl.[4] ..... F04B 17/00

[52] U.S. Cl. ..... 166/68.5; 166/106; 417/404

[58] Field of Search ..... 417/403, 404, 525, 526, 417/527, 511, 514; 166/68.5, 101, 105, 106

[56] References Cited

U.S. PATENT DOCUMENTS

| | | | |
|---|---|---|---|
| 3,182,598 | 5/1965 | McArthur et al. | 417/404 X |
| 4,032,266 | 6/1977 | Roeder | 417/571 |
| 4,084,923 | 4/1978 | Roeder | 417/404 X |
| 4,406,598 | 9/1983 | Walling | 417/404 |
| 4,477,234 | 10/1984 | Roeder | 417/393 |
| 4,492,537 | 1/1985 | Awerkamp | 417/404 |
| 4,541,783 | 9/1985 | Walling | 417/404 |
| 4,664,187 | 5/1987 | Roeder | 166/68.5 |

*Primary Examiner*—Stephen J. Novosad
*Assistant Examiner*—William P. Neuder
*Attorney, Agent, or Firm*—Marcus L. Bates

[57] ABSTRACT

A downhole hydraulically actuated pump assembly has an engine end and a pump end. A traveling valve assembly is included in both the engine end and the pump end. A discharge guide assembly is interposed between the engine and the pump ends, and thereby enables the connecting rod between the engine and pump ends to be greatly increased in length for a specific size. The traveling valve of the pump end includes a lost motion coupling by which the valve is shifted each stroke of the engine. A formation fluid passageway extends from the lower end of the pump, directly through a rod extension, and into the traveling valve. Accordingly, this novel combination and improvements provide a downhole pump assembly having the maximum diameter engine and pump piston.

14 Claims, 3 Drawing Sheets

DOWNHOLE HYDRAULIC ACTUATED PUMP

REFERENCE TO RELATED PATENT APPLICATIONS

This application is a continuation-in-part of my copending patent application Ser. No. 712,888 filed Mar. 18, 1985, now U.S. Pat. No. 4,664,186.

BACKGROUND OF THE INVENTION

In my copending patent application Ser. No. 712,888 filed Mar. 18, 1985, now U.S. Pat. No. 4,664,186, there is set forth a downhole hydraulically actuated pump having a traveling engine valve and a traveling production valve, and a discharge guide assembly connected between the engine and production ends. This unique assembly provides a downhole hydraulically actuated pump having the maximum possible size engine piston and pump plunger. This is so because no external passageways are required in order to provide the engine end with power fluid and to provide the pump end with formation fluid.

The present invention provides improvements in traveling valves for a pump plunger. The improved traveling valve can be used in my above recited, copending patent application, as well as various other types of reciprocating pumps, as for example, the various different downhole pumps referred in this and my copending patent application.

The traveling valve assembly of the present invention is unique in that a connecting rod extends through the pump plunger and forms the valve element. The lower end of the connecting rod extension provides an inlet by which formation fluid is conducted to the production valve assembly. The production plunger provides another part of the valve assembly, and passageways are formed therein which lead to the upper and lower production chambers.

The connecting rod enlargement and production plunger therefore form a lost motion coupling therebetween which move respective to one another in order to open and close the passageways leading to the upper and lower production chambers of the production end. The valve is actuated in response to movement of the connecting rod. This involves inertia, friction, and fluid pressure effected on the valve element and the pump plunger.

SUMMARY OF THE INVENTION

The present invention provides improvements in traveling valves for a pump plunger. The improved traveling valve is a production valve assembly that can be used in various types of reciprocating pumps, as for example, the various different downhole pumps referred in this and my copending patent application. The traveling valve assembly of the present invention is unique in that a connecting rod extends through the pump plunger and is enlarged to provide a valve element. The lower end of the connecting rod that extends through the pump provides an inlet by which formation fluid is conducted from the lower end of the pump, through the lower pump chamber, and to the production valve assembly.

The production plunger provides another part of the valve assembly in the form of a valve chamber. The plunger has passageways formed therein which lead to the upper and lower production chambers, or working chambers.

The connecting rod enlargement and production plunger therefore cooperate together to form a lost motion coupling therebetween which move a limited amount respective to one another in order to open and close the passageways leading to the upper and lower production chambers of the production end. The valve is actuated in response to movement of the connecting rod. This involves inertia, friction, and fluid pressure effected on the valve element and the pump plunger.

A primary object of this invention is the provision of a traveling valve assembly for the production end of a production pump which has only two moving parts.

Another object of this invention is to provide a traveling production valve that is built into the production plunger that is actuated in response to inertia, pressure differential, and friction.

A further object of this invention is to disclose and provide a traveling valve assembly which is enclosed within a pump plunger and has a valve element which is an enlargement of a connection rod extension, and which includes a marginal end which continues downhole to a source of formation fluid.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENTS

Figure 1:
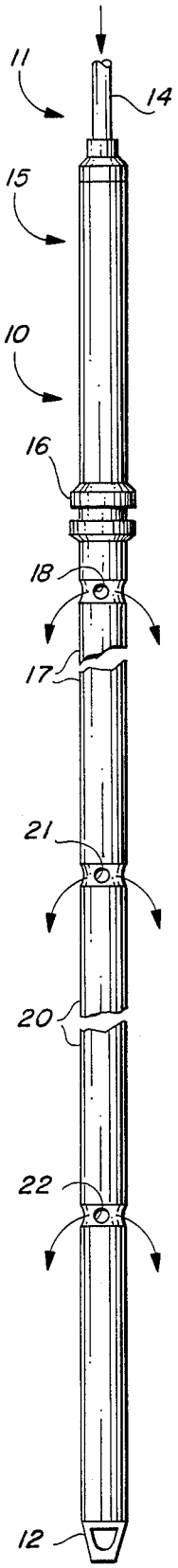
FIG. 1 is a broken, side elevational view of a downhole pump assembly made in accordance with the present invention.

In the figures of the drawings, and in particular FIG. 1, there is disclosed an improved downhole pump 10, many of the details being more fully set forth in my copending patent application Ser. No. 712,888 filed Mar. 18, 1985, now U.S. Pat. No. 4,664,186, of which this patent application is a continuation in part. The downhole pump 10 includes an upper end 11 opposed to a lower end 12. Production fluid flows into the nose or lower end 12 of the pump while hydraulic power fluid flows into the tubing 14 at the upper terminal end of the pump. An engine 15 is located uphole of a seal assembly 16. A grooved power fluid outlet section 17, the details of which are set forth in my above described patent application, exhausts spent power fluid from spent power fluid outlet ports 18.

A production pump assembly 20 is reciprocated by the engine end 15 and receives production fluid from the lower inlet end 12, and exhausts the produced fluid through production ports of outlet assembly 21 and 22.

Figure 2:
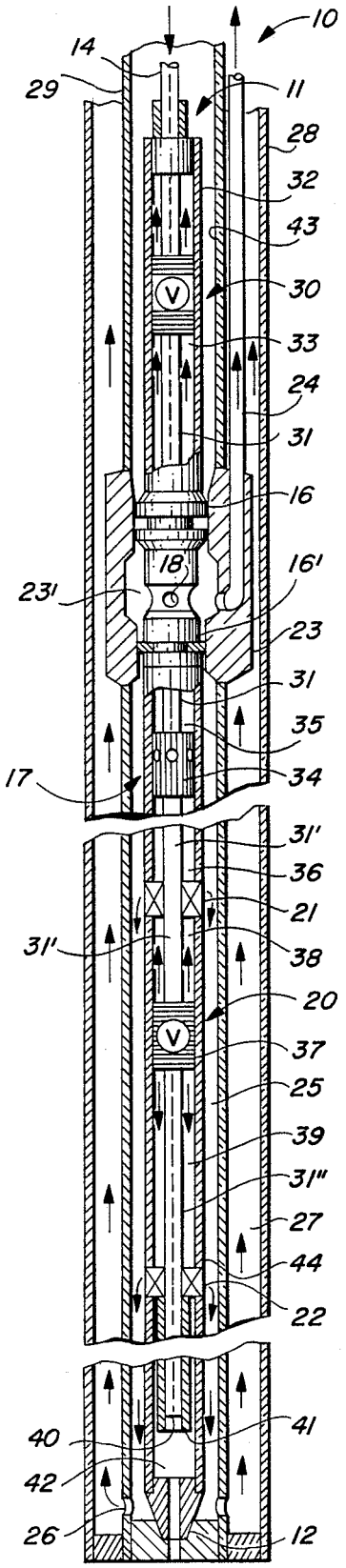
FIG. 2 is an enlarged, fragmentary, longitudinal, part cross-sectional view illustrating some of the details of the pump disclosed in FIG. 1.
Figure 3:
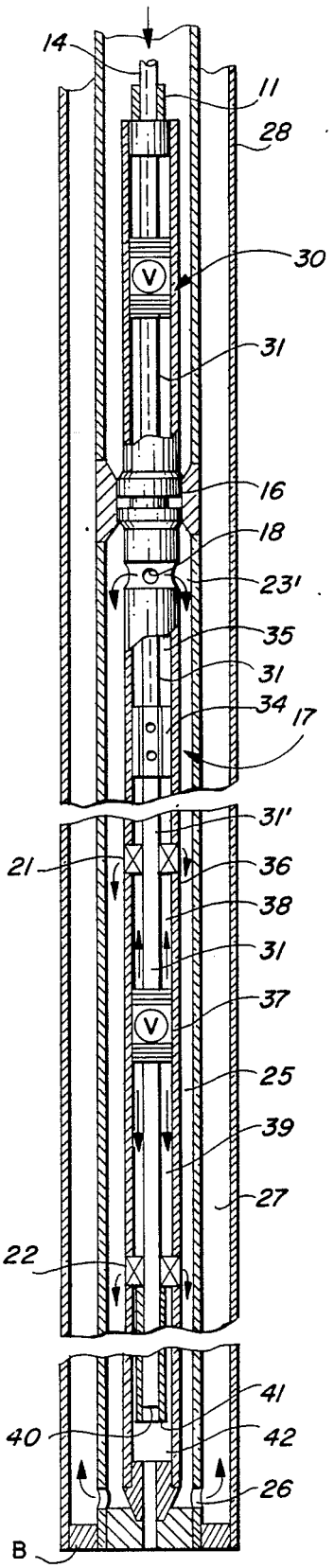
FIG. 3 is a longitudinal, part cross-sectional view of a modification of the pump seen in FIG. 2.

The pump of FIG. 1 can be of the free or fixed type as illustrated in FIGS. 2 and 3. In FIG. 2, the downhole pump assembly 10 is provided with a seal assembly 16, 16' which is received in sealed relationship within a receptable 23 so that the spent power fluid which exits port 18 must flow into the illustrated annulus 23', into the spent power fluid return conduit 24, and uphole to the surface of the ground. The production fluid exiting ports 21 and 22 of the outlet assembly flows into annulus 25, downhole to ports 26, up the annulus 27, and to the surface of the ground. The annulus 27 is formed between casing 28 and the power fluid string 29.

Engine end 15 includes a cylinder having a piston 30 which has a valve therein, made in accordance with my previous U.S. Pat. Nos. 3,517,741 issued June 30, 1970 and 3,627,048 issued Dec. 14, 1971. Therefore, the engine piston 30 is said to have a traveling valve associated therewith. The traveling valve receives power fluid from the hollow inlet rod 14 which communicates with the traveling valve assembly "V" of piston 30 and reciprocates therewith. A piston rod 31 is axially aligned with the power fluid inlet rod 14. The piston rod 31 extends axially down through the pump assembly, almost to the lower end thereof where the open end of the rod receives formation fluid, as will be more fully explained later on.

Piston 30 divides the engine 15 into an upper power chamber 32 and a lower power chamber 33. There are seal assemblies at the opposed ends of the upper and lower chambers for isolating the chambers so that fluid flows to and from the chambers only through the traveling valve "V".

The discharge section 17 includes the illustrated slide discharge element 34 which divides chamber 17 into an upper chamber 35 and a lower chamber 36. The slide 34 includes the illustrated ports therein which are connected to the interior of the hollow connecting rod 31 and communicates with the valve "V" of engine piston 30.

The production end of the pump assembly includes a production outlet valve and seal assembly schematically illustrated at 21 and 22; which define a production chamber within which a production piston 37, made in accordance with this invention, is reciprocatingly received. The novel production piston 37 of the present invention includes the illustrated valve means contained therewithin by which formation fluid is received through the lower hollow connecting rod, as will be more fully explained later on. The upper and lower production pump seal and outlet assembly 21, 22 exhaust produced fluid into the annulus 25. The annulus 25 is formed between the pump barrel and the oil supply string 29 so that the produced fluid is forced to flow downhole toward produced fluid outlet port 26, and then back up through the annulus 27 and to the surface of the ground. Accordingly, the pump system disclosed in FIG. 2 is of the type that maintains the power oil in a closed system which is separate from the produced fluid.

In the system set forth in FIG. 3, power fluid is pumped down the power oil string and enters the power oil inlet 14 as in the before described manner, and thereby reciprocates the engine piston 30 as the traveling valve causes the power oil to alternately flow into the upper and lower power chambers. Spent power fluid is alternately exhausted from the power oil chambers and flows from the valve, down through the connecting rod 31, to the guide device 34 where the oil is exhausted through the guide ports and into chamber 35, and then flows back up through the annulus to the outlet 18, and into the annulus 25 formed between the pump and the power oil string 29.

At the same time, formation fluid below the packer B enters the lower end of the pump, and flows into the lower connecting rod extension at inlet 40. Sleeve 41 sealingly and slidably receives the lower marginal end of the rod extension 31'' in a reciprocating manner.

Figure 7:
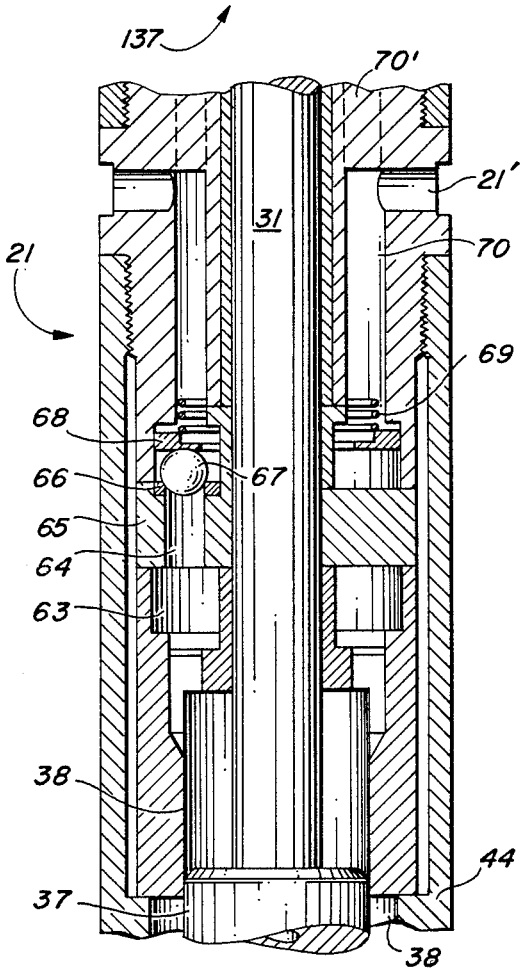
FIG. 7 is an enlarged, fragmentary, longitudinal, part cross-sectional view of part of the apparatus disclosed in FIGS. 1–3; and, FIG. 8 is an enlarged, fragmentary, longitudinal, part cross-sectional view of another part of the downhole pump disclosed in FIGS. 1–3.
Figure 8:
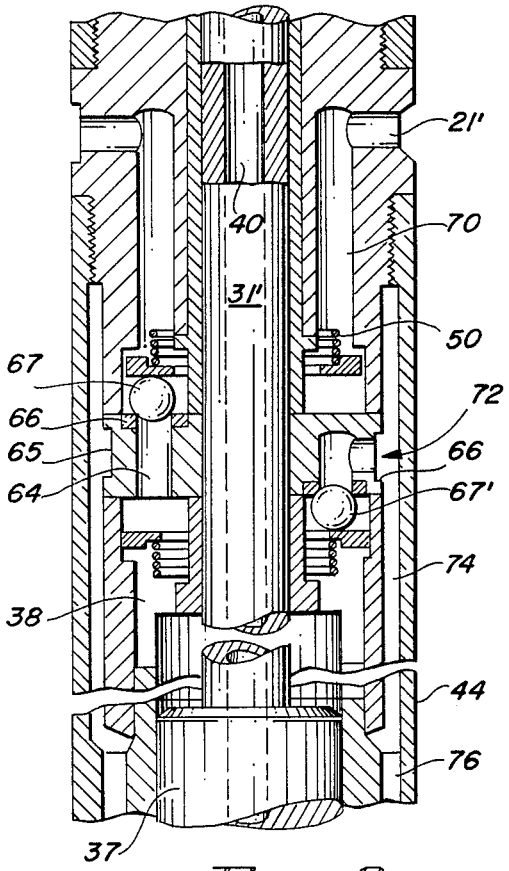

As the production piston 37 reciprocates within the pump barrel, formation fluid flows through the pump piston traveling valve and into alternate ones of the chambers 38, 39, while the produced fluid is alternately exhausted from the production chambers by means of the seal and outlet assembly 21 and 22, the details are set forth in FIG. 7.

Accordingly, spent power fluid from port 18 and produced fluid from the production check valves 21 and 22 of the seal and outlet assembly comingle within the annulus 25 and exit the power oil string annulus at ports 26 where the mixed fluid flows uphole through casing annulus 27.

Figure 4:
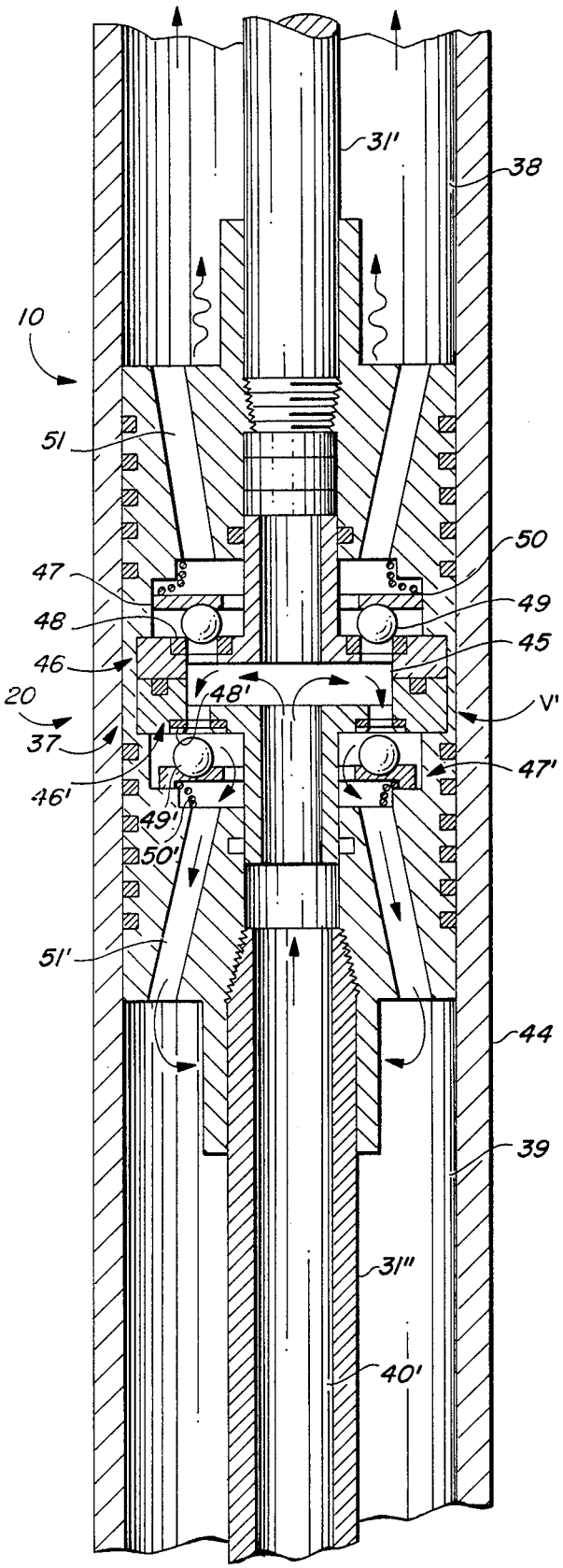
FIG. 4 is a further enlarged, fragmentary, longitudinal, part cross-sectional view of part of the apparatus disclosed in the foregoing figures.
Figure 5:
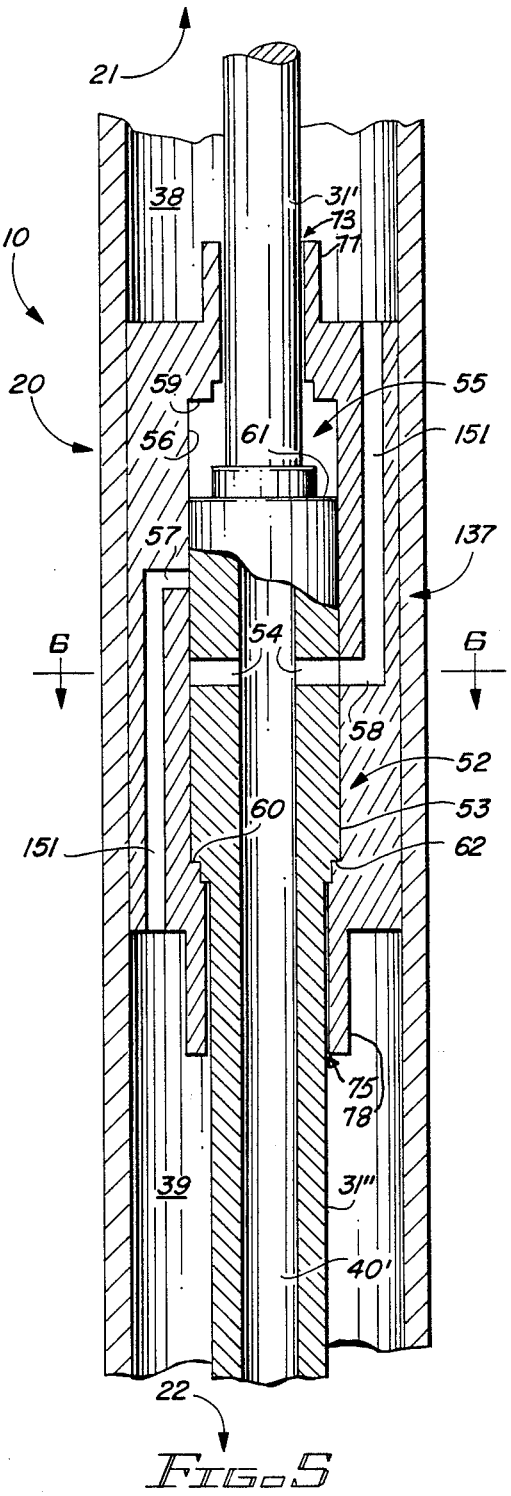
FIG. 5 sets forth a modification of the apparatus disclosed in FIG. 4.
Figure 6:
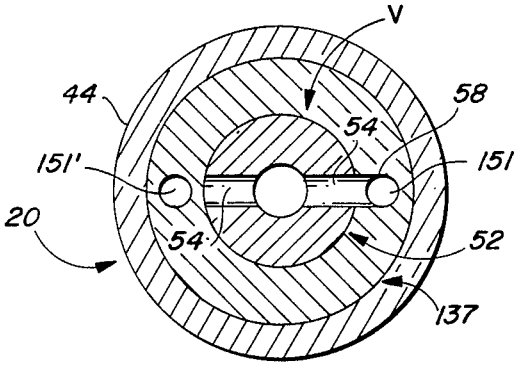
FIG. 6 is a cross-sectional view taken along line 6—6 of FIG. 5.

FIGS. 4–6 of the drawings illustrate the details of alternant embodiments of the production piston 37 which were diagrammatically disclosed in the foregoing figures. As seen in the first embodiment of FIG. 4, the production piston 37 is reciprocated by connecting rod 31' in response to reciprocation of the engine piston 30 of FIGS. 2 and 3. The rod 31' of FIGS. 4 and 5 interconnecting the engine piston and the adjacent production piston is solid up to the guide members 34, (FIG. 3) where the rod must then be hollow so that the sliding guide member 34 can receive spent power fluid from the valve of piston 30.

FIG. 7 shows an outlet production valve assembly which can be used for controlling the flow of produced fluid from chambers 38 and 39 of either of the embodiments of the invention set forth in FIGS. 4 and 5. The details of FIG. 7 are more fully set forth later on herein.

Where a double production end is desired, the connecting rod 31 of FIG. 7 must be made hollow between the two production pistons as indicated by the numerals 37 and 137 in order to also provide formation fluid to the second production piston 137 (not shown). An outlet passageway 70' would also be required so that produced fluid from the adjacent production chamber can be exhausted through port 21 of the outlet assembly, for example. The double production ends would be placed one above the other with formation fluid being supplied to both production ends by means of the hollow rod 31.

In FIGS. 4–7, outer pump housing 44 forms upper and lower working chambers 38 and 39, with formation fluid entering a formation fluid chamber 45 by means of the internal passageway 40' formed within the lower connecting rod extension 31''. As the plunger, or piston 37, stroks upward, the fluid in the upper production chamber 38 is exhausted through the upper check valve means 21 (FIGS. 2 and 3), the details of which are more fully disclosed in FIG. 7. At the same time, formation fluid enters the lower end 12 (FIG. 2) of the pump, and flows into the lower end 40 of the connecting rod extension 31", then flows through passageway 40', into chamber 45, and then through the seat 48 and the lower ball check valves 49', spring 50', and production piston passageway 51', thereby filling the lower production cylinder chamber 39 with formation fluid. The lower exhaust valve 22 (FIG. 2) is constructed identical to the exhaust valve 21 and the two valves 21 and 22 are arranged in confronting relationship respective to the opposed ends of the piston in the illustrated manner of FIG. 7.

In FIGS. 5 and 6, there is set forth a novel improvement of the production end 20 of the pump 10 disclosed in the foregoing figures. The improvement comprises an alternate embodiment of the combination valve and production piston 37 previously seen in FIGS. 1–4. The combination traveling valve 52 and plunger 137 includes a unitary valve element which is contained within a unitary production plunger, and as seen illustrated in FIGS. 5 and 6, the cylindrical sliding valve element 52 is connected within the connecting rod 31' and hollow rod extension 31". The connecting rod at 31' can be made solid where only one production piston or plunger 137 is employed in the production end. The valve element 52 includes a cylindrical outer body surface 53 having lateral ports 54 extending radially from the central passageway 40' thereof.

A cylindrical chamber 55 is formed axially within hollow plunger 137 and slidably receives the valve element 52 in a reciprocating manner in close tolerance relationship therewithin. The chamber 55 is of a length to slidably receive the valve element 52 in captured relationship therewithin as seen illustrated in FIG. 5. The valve element 52 and plunger 137 are advantageously used for controlling fluid flow from formation fluid passageway 40' alternately to the opposed production chambers 38 and 39.

Numeral 56 indicates the inside peripheral wall surface of the chamber 55. Lateral ports 57 and 58, respectively, are connected to chambers 38 and 39, respectively, by means of separate longitudinal passageways 151, 151, respectively. Chamber 55 includes opposed annular shoulders 59 and 60 formed at opposed ends thereof for abuttingly engaging the coacting opposed shoulders 61 and 62 formed at opposite ends of the valve element 52.

Hence, shoulders 60, 62 and 59, 61 form stop means to limit the relative axial motion between the plunger and valve element each stroke that the engine imparts into the connecting rod. The ports 57, 58 are spaced axially from one another a distance equal to the maximum spacing of annular shoulders 59 and 61 or 60 and 62 when the valve element 52 is stroked by the engine so that as the valve element 52 abuttingly engages either of the plunger shoulders 59 and 60, one of the ports, 57 or 58, are aligned with one of the valve element ports 54. Accordingly, as the engine downstrokes connecting rod 31', the plunger and valve assembly assume the configuration set forth in FIGS. 5 and 6; and, when the engine upstrokes the rod 31', the production plunger and valve assembly assume that alternate configuration wherein shoulders 59 and 61 abuttingly engage one another and ports 54 and 57 are brought into alignment with one another.

In FIG. 7, there is disclosed the details of the production valve outlets and seal assemblies 21 and 22 of FIG. 3, for example. The production valve element 21 is arranged in opposed relationship at the opposed ends of the chambers 38 and 39 as illustrated at 21 and 22 in FIGS. 2 and 3.

The chamber 38 of the production end communicates with produced fluid chamber 63 so that a source of production fluid is available at circumferentially spaced apart ports 64 formed within plate member 65. Each of the ports 64 are provided with a valve seat 66 formed in the face of plate member 65 which is opposed to the piston or plunger 37. The seat accommodates each of the ball check valves 67 which are biased against the set by means of the illustrated annular plate 68. Compression spring 69 biases the plate 68 against the balls 67, which is biased against seat 66 of plate 65, thereby maintaining passageways 64 closed to the flow of fluid except in the direction of outlet passageway 70. Outlet passageway 70 communicates with ports 21 which flow into annulus 25 (FIG. 3). This valve can also be used in a number of other double acting pumps.

In operation, the pump of FIGS. 1 and 2 is circulated downhole as a free pump, in a manner known to those skilled in the art, until the seal 16 and nose 12 are seated respective to a seating receptacle, such as seen in FIGS. 2 and 3, for example. In FIGS. 2 and 3, power fluid flows down power oil string 29, into the stinger 14, where power fluid is available at the traveling valve "V" of the engine piston 30, and thereby causes the piston 30 to reciprocate within the engine cylinder, while spent power oil is exhausted to hollow connecting rod 31 and to the sliding guide member 34 and then flows out of the spent power fluid outlets 18.

This action reciprocates pump piston 37 located in the production end 20 of the downhole pump assembly 10. The pump intake 12 provides a source of formation fluid at suction chamber 42 so that the lower rod extension 31" of FIG. 5 receives formation fluid at inlet end 40 (FIG. 3). This provides the traveling valve assembly of the production piston 137 with a source of formation fluid. The formation fluid flows through the valve 52 and to alternate ones of the chambers 38 and 39.

At the same time, produced fluid is forced from the other of the chambers 38 and 39 and through one of the seal and outlet assemblies 21, 22 (FIGS. 2 and 3). The details of one of the valve of the seal and outlet assemblies 21 and 22 are shown in FIG. 7, and it can be seen that fluid flows from production chamber 38, into annular chamber 63, through one of a plurality of circumferentially extending ports 64 which are normally closed by the seated ball check valve 67. The ball check valve 37 is urged into the seated position by the biasing means 68, 69. Pressure differential across the check valve unseats the ball 67 and flow occurs from port 64, across the ball, through passageways 70, and out of the ports 21' where fluid is free to be conducted to the surface of the ground.

An annulus, 73 and 75, is located at opposed end, 77 and 78, of piston 137 and communicates the internal bore, or chamber 55, of the piston 137 with the production chamber 38 and 39. The annulus, 73 and 75, provides a fluid flow passageway through which fluid can be transferred between the opposed variable chambers 55, located at opposed ends of the valve element 52, and the production chambers 38 and 39, each reciprocation of the production piston 137.

The present invention provides a double acting pump which is provided with the maximum size piston in both the engine and the pump end. The guide means 31, 34, 31' interconnectes the engine piston to the pump plunger with a guide device that reduces rod bending and thereby enable a smaller diameter rod to be used. The utilization of the hollow connecting rod together with the traveling valves in both the engine and production piston enables the pistons to be made the very largest possible diameter inasmuch as the necessity of flow ports through the barrel or outer pump housing is obviated by the novel flow system employed by the present invention.

I claim:

1. In a downhole hydraulically actuated pump assembly of the type having a main housing within which an engine and pump is enclosed; a connecting rod, an engine piston, a pump plunger, means by which said engine and connecting rod reciprocate said pump plunger and thereby produces fluid;

said main housing has a lower end having a formation fluid inlet; an upper end having a power fluid inlet; and, a produced fluid outlet;

said plunger divides one marginal end of said housing into upper and lower production chambers; the lower end of said connecting rod is hollow and extends through said plunger into fluid communication with said formation fluid inlet to provide a source of formation fluid for said upper and lower production chambers;

a traveling valve assembly contained within said plunger and arranged to transfer formation fluid from said hollow rod, through said plunger, and into said upper and lower production chambers, respectively, as said plunger upstrokes and downstrokes;

produced fluid valve means by which fluid flows from said upper and lower production chambers and through said produced fluid outlet;

said plunger has an axial passageway extending therethrough; said passageway is reduced in diameter at opposed ends thereof to provide upper and lower internal shoulders;

said connecting rod is enlarged within said plunger to provide a cylindrical valve element having shoulders formed at opposed ends thereof for engaging said upper and lower internal shoulders; said valve element is reciprocatingly received in closes tolerance relationship within said axial passageway; said connecting rod has a marginal free end that extends through said lower production chamber and has a terminal end for receiving formation fluid therein;

lateral flow port means formed through said valve element; upper and lower opposed longitudinal passageway formed through an upper and a lower medial length of said plunger; means connecting said lower passageway to said lateral port when the plunger reciprocates uphole, and connecting the other upper longitudinal passageway when the plunger is reciprocated downhole;

whereby; said valve element moves downwardly within said axial passageway on the downstroke, thereby aligning the lateral port and longitudinal passsageways; and providing for flow of formation fluid into the production chambers.

2. The pump assembly of claim 1 wherein said engine piston divides the upper end of the housing into upper and lower engine chambers and includes traveling valve means therein, the upper end of said connecting rod extends through said engine, by which power fluid flows from the upper end of the housing, through the rod extension, into the engine piston, and alternately into the upper and lower engine chambers, thereby providing a downhole pump having the maximum diameter engine and production pistons therein.

3. The pump assembly of claim 1 wherein said engine piston and pump plungers are double acting and pump fluid on each upstroke and downstroke.

4. The pump assembly of claim 1 wherein a discharge guide means is located within said main body at a location between said engine and said pump end, said discharge guide means includes a medial length of said connecting rod which is enlarged in diameter and reciprocatingly received within a discharge guide chamber; passageway means leading from the engine valve assembly to the interior of the connecting rod, through the enlarged diameter part of the connecting rod, into the guide chamber, and through the main body through which spent power fluid can be exhausted.

5. The pump assembly of claim 1 wherein said engine includes a traveling valve means therein by which power fluid flows from the upper end of the housing, through an upper rod extension, into the piston, and alternately into the upper and lower engine chambers, thereby providing a downhole pump having the maximum diameter pistons therein.

6. The pump assembly of claim 5 wherein a discharge guide means is located within said main body at a location between said engine and said pump end, said discharge guide means includes a medial length of said connecting rod which is enlarged in diameter and reciprocatingly received within a discharge guide chamber; passageway means leading from the engine valve assembly to the interior of the connecting rod, through the enlarged diameter part of the connecting rod, into the guide chamber, and through the main body through which spent power fluid can be exhausted.

7. In a hydraulically actuated downhole pump assembly of the type having a main housing which is formed into an engine end and a production end, means by which the engine end is connected to drive the production end, there being an engine chamber and a production chamber, a piston reciprocatingly received within the engine chamber, a plunger reciprocatingly received within the production chamber, and dividing the production end of the housing into upper and lower production chambers, a connecting rod by which the piston and plunger are connected together;

valve means by which production fluid discharged from the upper and lower production chambers is conducted away from the pump assembly;

said plunger has a longitudinal bore formed therethrough, a cylindrical valve element reciprocatingly received within said bore, stop means by which the valve element reciprocates a limited distance on each upstroke and downstroke;

passageway means extending from the lower end of the housing to the cylindrical valve element for providing formation fluid thereto; longitudinal passageway means extending from the bore of the plunger into communication with the upper and lower production chambers; port means connecting the passageway means to alternate ones of the upper and lower production chambers;

whereby: as the engine upstrokes and downstrokes the plunger, formation fluid is moved through the production end of the pump assesmbly.

8. The pump assembly of claim 7 wherein said plunger has an axial passageway extending therethrough; said passageway is reduced in diameter at opposed ends thereof to provide spaced stop means in the form of upper and lower shoulders;

said cylindrical valve element having shoulders formed at opposed ends thereof for engaging said upper and lower shoulders; said valve element is reciprocatingly received in close tolerance relationship within said axial passageway; said connecting rod is affixed to one opposed end of said valve element, a rod extension is affixed to the other opposed end of said valve element;

said port means is a lateral flow passageway formed through said valve element; said longitudinal passageway means includes upper and lower opposed longitudinal passageways formed through an upper and a lower medial length of said plunger; means connecting said lower passageway to said lateral flow passageway when the plunger reciprocates uphole, and connecting the other upper longitudinal passageway when the plunger is reciprocated downhole;

whereby said valve element moves downwardly within said axial passageway on the downstroke, thereby aligning the lateral port and longitudinal passageways; and providing for flow of formation fluid into the production chambers.

9. The pump assembly of claim 7 wherein said engine includes a traveling valve means therein by which power fluid flows from the upper end of the housing, through an upper rod extension, into the piston, and then alternately into the upper and lower engine chambers, thereby providing a downhole pump having the maximum diameter pistons therein.

10. The pump assembly of claim 9 wherein said engine piston and pump plungers are double acting and produce fluid on each upstroke and downstroke.

11. The pump assembly of claim 8 wherein a discharge guide means is located within said main body at a location between said engine and said pump end, said discharge guide means includes a medial length of said connecting rod which is enlarged in diameter and reciprocatingly received within a discharge guide chamber; passageway means leading from the engine valve assembly to the interior of the connecting rod, through the enlarged diameter part of the connecting rod, into the guide chamber, and through the main body through which spent power fluid can be exhausted.

12. The pump assembly of claim 11 wherein said engine includes a traveling valve means therein by which power fluid flows form the upper end of the housing, through the rod extension, into the piston, and into the upper and lower engine chambers, thereby providing a downhole pump having the maximum diameter pistons therein.

13. Improvements in a hydraulically actuated pump assembly of the type having a main body within which there is formed an engine chamber and a production chamber; an engine piston reciprocatingly received within the engine chamber and dividing the engine chamber into upper and lower power chambers;

a pump plunger reciprocatingly received within the production chamber and dividing the production chamber into upper and lower production chambers; a connecting rod connecting the plunger to the engine piston, intake valve means by which formation fluid can flow into alternate ones of the production chambers, outlet valve means by which produced fluid can flow from said production chambers;

an upper connecting rod extension aligned longitudinally respective to said engine piston and connected to a power fluid source; a control valve means located within said engine piston, said control valve means reciprocates between two alternate positions in response to the location of the engine piston; said control valve means controls the flow of power fluid from said connecting rod extension to alternate upper and lower engine chambers, and controls the flow of spent power fluid from alternate lower and upper engine chambers;

a lower hollow rod extension connected to said plunger and extending towards the lower end of said production chamber; said intake valve means is a traveling valve assembly contained within said plunger and arranged to transfer formation fluid from said hollow rod extension, through said plunger, and into said upper and lower production chambers, respectively, as said plunger upstrokes and downstrokes;

said plunger has a longitudinal bore formed therethrough, a cylindrical valve element recriprocatingly received within said bore, stop means by which the valve element reciprocates a limited distance on each upstroke and downstroke.

14. The pump assembly of claim 13 and further including a discharge guide means which is located within said main body between said engine chamber and said production chamber, said discharge guide means includes a medial length of said connecting rod which is enlarged in diameter and reciprocatingly received within a discharge guide chamber; passageway means leading from the interior of the connecting rod, through the enlarged diameter part of the connecting rod, into the guide chamber, and through the main body through which spent power fluid can be exhausted;

means forming a first flow path which extends through said connecting rod extension, through said control valve means, and into one of the power chambers whereby power fluid effected within said connecting rod forces said engine piston to stroke when said control valve means is in one of the alternate positions; means forming a spent power fluid flow path which extends from the other said power chamber into said piston, through said control valve means, into said connecting rod, and to said discharge guide means so that power fluid can be exhausted from the other power chamber when said control valve means is in one of the alternate positions;

whereby power fluid forces said piston to stroke uphole and thereafter forces said piston to stroke downhole, thereby reciprocating said plunger and causing formation fluid to flow through said production chamber in response to reciprocal action of said pump plunger.

* * * * *

UNITED STATES PATENT AND TRADEMARK OFFICE

CERTIFICATE OF CORRECTION

PATENT NO. : 4,768,589

DATED : SEPTEMBER 6, 1988

INVENTOR(S) : GEORGE K. ROEDER

It is certified that error appears in the above-identified patent and that said Letters Patent is hereby corrected as shown below:

Column 1, line 42, substitute --member 34-- for "members 34";

Column 7, line 48, substitute --close-- for "closes";

Line 55, substitute --passageways-- for "passageway";

Line 68, insert an --a-- after "includes";

Column 9, line 37, substitute --from-- for "form".

Signed and Sealed this

Twenty-eighth Day of February, 1989

*Attest:*

DONALD J. QUIGG

*Attesting Officer*

*Commissioner of Patents and Trademarks*